US006053379A

United States Patent [19]

Balph

[11] Patent Number: 6,053,379

[45] Date of Patent: Apr. 25, 2000

[54] GARMENT HANGER SLEEVE EXTENSION

[76] Inventor: Bette Balph, 212 Mission Meade Dr., New Castle, Pa. 16105

[21] Appl. No.: 09/268,063

[22] Filed: Mar. 15, 1999

[51] Int. Cl.[7] ..... A47G 25/20

[52] U.S. Cl. ..... 223/98

[58] Field of Search ..... 223/98, 85, 92, 223/88

[56] References Cited

U.S. PATENT DOCUMENTS

| | | | |
|---|---|---|---|
| 2,099,308 | 11/1937 | McAllister . | |
| 2,524,978 | 10/1950 | Humphreys . | |
| 2,525,158 | 10/1950 | Derbeck | 223/98 |
| 2,814,426 | 11/1957 | Miller . | |
| 2,884,171 | 4/1959 | Knuth . | |
| 3,212,687 | 10/1965 | Bradley | 223/98 |
| 3,347,428 | 10/1967 | Gauthier | 223/98 |
| 5,085,358 | 2/1992 | Lam . | |
| 5,197,639 | 3/1993 | Jerman et al. | 223/98 |
| 5,344,054 | 9/1994 | Nutter . | |
| 5,476,199 | 12/1995 | Halverson et al. . | |
| 5,718,362 | 2/1998 | Silverman . | |
| 5,727,718 | 3/1998 | Lam . | |

*Primary Examiner*—Bibhu Mohanty
*Attorney, Agent, or Firm*—Harpman & Harpman

[57] ABSTRACT

A hanger extension that in one embodiment is telescopically positioned on an open type hanger to extend the hanger within the sleeves of a garment hanging thereon. The extensions are held in place by releasable engagement over respective free ends of the padded hanger. Each extension has a hanger engagement portion and an elongated sleeve insertion portion of tubular shape covering filled with padded material to be yieldably self-supporting within the sleeves of the garment preventing wrinkles associated with crushing and folding of unsupported sleeves in closet environments.

7 Claims, 3 Drawing Sheets

GARMENT HANGER SLEEVE EXTENSION

BACKGROUND OF THE INVENTION

1. Technical Field

This invention relates to garment hangers that are used to support and suspend garments on a hanger rod for storage purposes.

2. Description of Prior Art

Prior art hangers typically are formed from bent wire in a modified triangular shape with a hook formed at their joining ends. Garment hangers can also be made out of contoured wood and plastic, for example. Padded garment hangers can be a combination of a base support material such as wood, wire or plastic with a synthetic foam covering or alternately fiber filled fabric covering to generally increase the relative diameter and to provide a soft engageable surface for the garment to be supported thereon. Other prior art garment hangers have adjustable length extension that increase the relative length of the hanger's upper support surface, see for example U.S. Pat. Nos. 2,099,308, 2,524,978, 2,814,426, 2,884,171, 5,085,358, 5,344,054, 5,476,199, 5,718,362 and 5,727,718.

In U.S. Pat. No. 2,099,308 a slip on cover for wooden hangers is disclosed to provide elongated padded surfaces thereon.

U.S. Pat. No. 2,524,978 is an adjustable shoulder form hanger having an extension attachment deployable from the respective ends.

U.S. Pat. No. 2,814,426 claims a coat hanger having telescopic extensions that are incrementally advanced from the hanger's body.

U.S. Pat. No. 2,884,171 is on a garment hanger having sliding oversized extensions extending from the body portions in oppositely disposed relation thereto.

U.S. Pat. No. 5,085,358 is directed to an adjustable clothes hanger having notched support arms with respective extension arms slideably and pivotally interfitted thereon for extension therefrom.

U.S. Pat. No. 5,344,054 defines an adjustable garment hanger having opposing longitudinally slotted stationary arms with movable extensions therein.

U.S. Pat. No. 5,476,199 discloses an extensible clothes hanger having extension arms slideably disposed thereon by pairs of gripping clamps registerable in opposing elongated grooves in the respective main body member support elements.

U.S. Pat. No. 5,718,362 is directed towards a modified garment hanger having a telescopic sleeve overlay that defines a contoured enlargement and extensible garment engagement surfaces.

Finally, a garment hanger assembly kit is described in U.S. Pat. No. 5,727,718 wherein a hanger having a pair of supporting arms and a pair of adjustable extensible extension arms on the respective distal ends.

SUMMARY OF THE INVENTION

An extension for a garment hanger that is removably secured to the garment hanger respective support arms. The extension comprises a pair of elongated sleeve inserts that provide inner support for the sleeve portion of the garment. Each of the sleeve inserts extend from the respective distal ends of the padded garment hanger and are secured thereto by frictional fit and attachment elements registerable on the support garment hanger in spaced relation to the sleeve inserts.

DESCRIPTION OF THE PREFERRED EMBODIMENT

Figure 1:
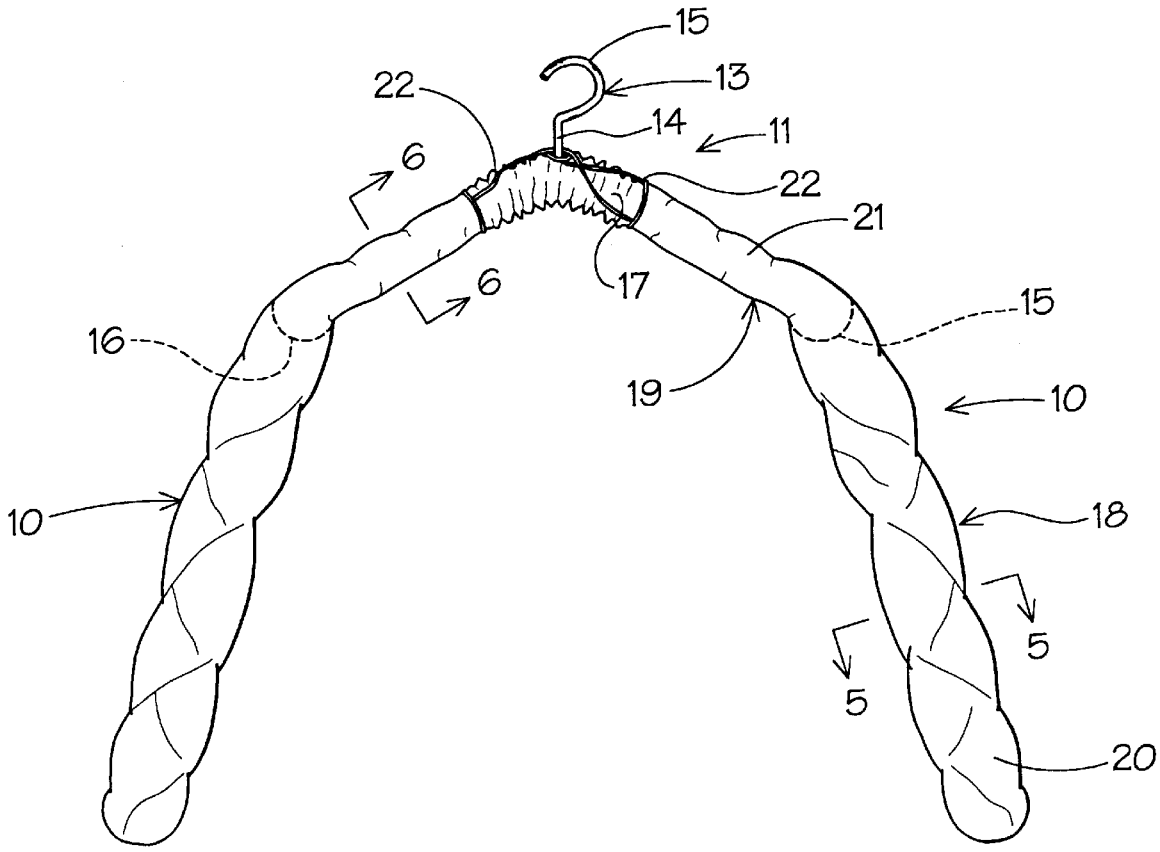
FIG. 1 is a front elevational view of the preferred form of the invention in place on a garment hanger.
Figure 2:
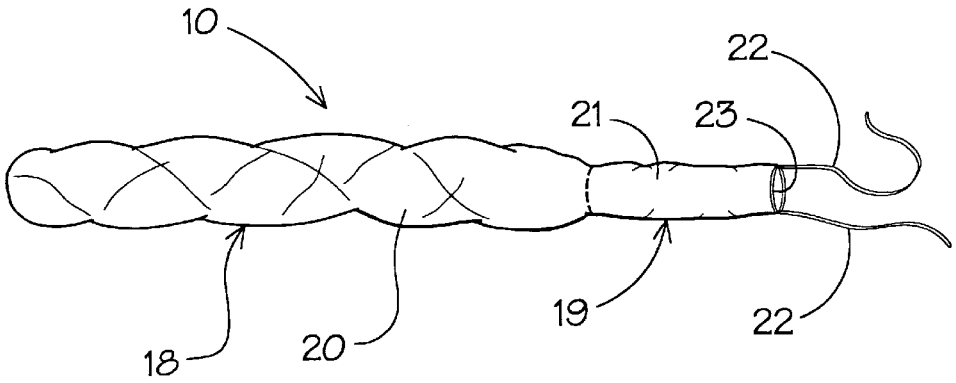
FIG. 2 is a front elevational view of one element of the preferred form of the invention.
Figure 6:
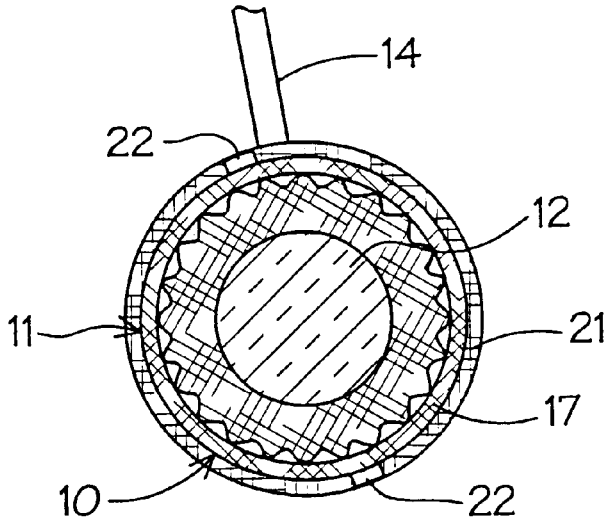
FIG. 6 is an enlarged cross-section on lines 6—6 of FIG. 1 of the preferred form of the invention.

Referring to FIGS. 1, 2 and 6 of the drawings, the preferred form of the garment hanger sleeve extension 10 of the invention can be seen on a typical padded garment hanger 11 which has an elongated curved main support body member 12. A metal hook 13 having a base 14 and a hook portion 15 extend from and are secured to the main support body 12 mid-way between its respective distal ends 15 and 16 as shown in dotted lines. A padded fabric covering at 17 envelopes the main support body member 12 and defines garment engagement surfaces as is well known within the art. The garment sleeve extensions 10 of the invention have an elongated sleeve insert portion 18 and a hanger engagement portion 19. The elongated sleeve insert portion 18 is cross-sectionally round having an outer fabric covering 20 defining an enclosed area which is filled with a high density synthetic filler fiber 21. The outer fabric covering 20 is in this example chosen for illustration quilted to help define and maintain the desired form suitable for ease of insertion into garments, not shown, sleeve portion. The hanger engagement portion 19 extends from the sleeve insert portions 18 and is of a diminished transverse dimension having elongated fabric sleeve with a pair of fastening cords 22 extending from its open end at 23.

In use, the hanger engagement portions 19 are pulled over the respective distal free ends 15 and 16 of the fabric covered main support body member 12 of the garment hanger 11 as best seen in FIG. 1 of the drawings. The fastening cords 22 are looped around the base 14 of the hanger hook 13 and secured to one another thus removably securing the respective sleeve extensions 10 thereon.

Figure 3:
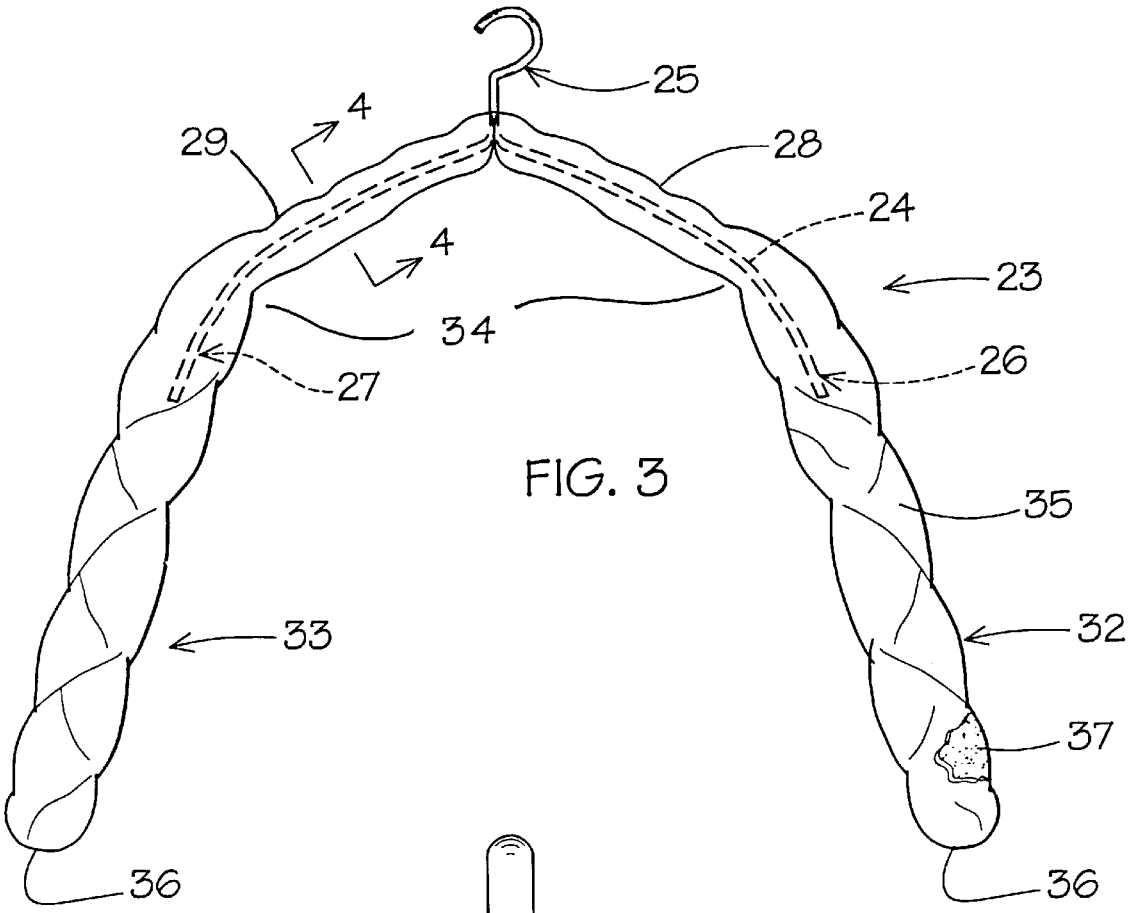
FIG. 3 is a front elevational view of an alternate form of the invention for a garment hanger wherein the extensions are integrally formed with the hanger.
Figure 4:
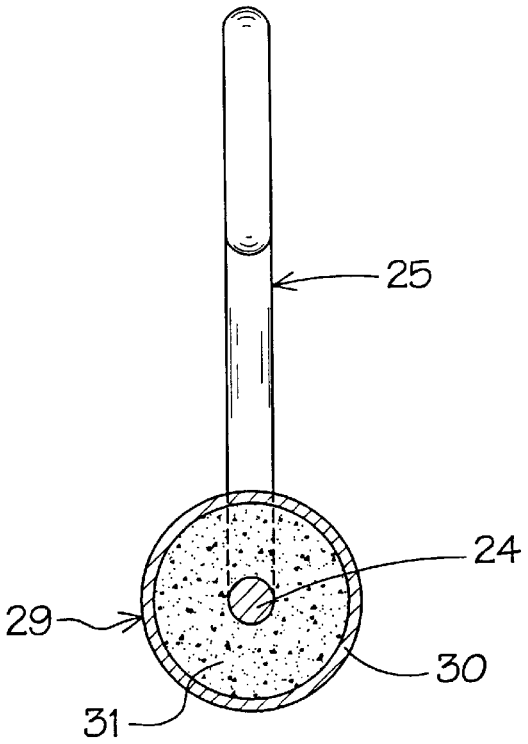
FIG. 4 is an enlarged cross-sectional view on lines 4—4 of FIG. 3.
Figure 5:
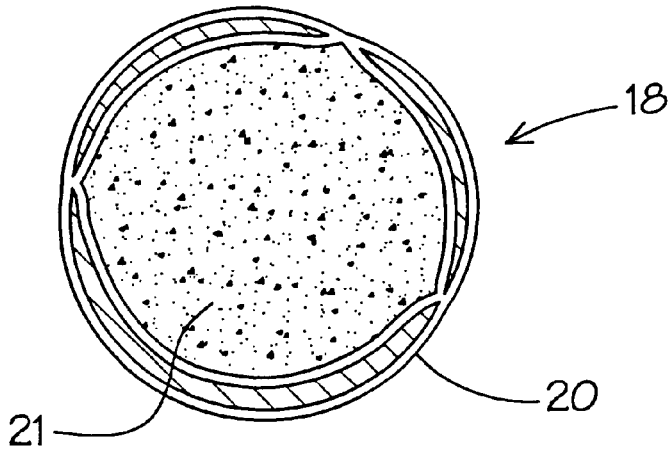
FIG. 5 is an enlarged cross-section on lines 5—5 of FIG. 1.

Referring now to FIGS. 3, and 4 of the drawings, an alternate form of the invention can be seen wherein a garment hanger 23 is formed from a contoured interior support rod 24 shown in dotted lines and an upstanding integral hanger hook 25 extending midway therefrom. The support rod 24, preferably of metal defines arm support portions 26 and 27 that extend generally downwardly as seen in dotted lines in FIG. 3 of the drawings. Elongated support portions 28 and 29 extend around and from the respective arm rod supports 26 and 27 defining a pair of sleeve inserts 32 and 33 respectively integrally therefrom about the end portion of the rod 24 with an increase cross-sectional diameter beginning at respective transition points 34.

Each of the sleeve insert extensions 32 and 33 have an outer fabric surface 35 defining an elongated tubular element closed at theit respective free ends 36. The sleeve inserts 32 and 33 are filled typically with high density synthetic fabric batting 37 that is packed therein, imparting a rigid tubular configuration to the respective inserts as best seen in FIGS. 3 and 4 of the drawings.

The alternate garment hanger 23 of the invention functions as the hereinbefore described garment hanger sleeve extensions 10 on the hanger 11 preventing the sleeve of the garment, not shown, from being crushed or folded when in storage. The outer fabric surface 35 is sewn together by traditional techniques and may be of a quilted double layer infilled padded batting to delineate its outer smooth surface over the synthetic filling 37 as hereinbefore described.

In the preferred form of the invention 10 or in the alternate form as an integral hanger 23 as shown in FIG. 3 of the drawings, the respective overall length of the respective sleeve insert portions is that equal to or slightly greater than that of the length of the garment sleeve, not shown, so as to afford adequate interior support of the respective sleeves once the garment, not shown, is positioned on the modified hangers of the invention.

It will be apparent that by use of the yielding synthetic fiber filling in the respective sleeve insert portions that they will maintain the desired original sleeve positioning of the garments on hangers in which the sleeves extend from the hanger in a vertical orientation along side the garment.

It will be apparent to those skilled in the art that various changes and modifications may be made thereto without departing from the spirit of the invention.

Therefore I claim:

1. Garment hanger sleeve insert extensions for garment hangers, said sleeve insert extensions comprising an elongated tubular body member having a hanger engagement portion and a sleeve insert portion, said hanger engagement portion comprising a thin flexible fabric engagement sleeve with fastening means extending therefrom for selective engagement with said garment hanger, said sleeve insert portion comprising a tubular element having closed distal and proxal ends filled with high density synthetic filler to impart rigidity to said respective sleeve insert portions said hanger engagement portion is of a known transverse dimension equal to that of said garment hanger on which it is engaged, and said sleeve insert portion is of a transverse dimension greater than that of said known hanger engagement portion.

2. The garment hanger sleeve insert extensions set forth in claim 1 wherein said flexible engagement sleeve and said sleeve insert portions are preferably made of fabric material secured together by stitching means.

3. The garment hanger sleeve insert extensions set forth in claim 1 wherein said fastening means extending from said hanger engagement portions comprises; a pair of fabric cords.

4. The garment hanger sleeve insert extensions set forth in claim 1 wherein said engagement sleeve of said hanger engagement portion has an open end and a closed end.

5. A garment hanger comprising an internal support frame, a hook extending from said frame, said support frame having elongated oppositely disposed support portions extending from said hook, elongated arm support portions extend around and from said oppositely disposed support portions, sleeve inserts integral with said respective elongated arm support portions, said sleeve inserts defining elongated tubular enclosures having closed distal ends, said tubular enclosures filled with resilient filling material, said elongated tubular enclosures extending substantially beyond said respective oppositely disposed support portions.

6. The garment hanger set forth in claim 5 wherein said elongated support portions are of a known transverse dimension and said sleeve insert portions are of a transverse dimension greater than that of said known sleeve transverse dimension.

7. The garment hanger set forth in claim 5 wherein said elongated support portions and said sleeve insert portions are preferably made of fabric material.

* * * * *